US007008309B2

(12) United States Patent
Strasbaugh

(10) Patent No.: US 7,008,309 B2
(45) Date of Patent: Mar. 7, 2006

(54) BACK PRESSURE CONTROL SYSTEM FOR CMP AND WAFER POLISHING

(75) Inventor: Alan Strasbaugh, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 10/452,411

(22) Filed: May 30, 2003

(65) Prior Publication Data

US 2004/0242135 A1 Dec. 2, 2004

(51) Int. Cl.
*B24B 7/22* (2006.01)

(52) U.S. Cl. ..... 451/285; 451/287; 451/398; 451/402

(58) Field of Classification Search ..... 451/285, 451/287, 289, 288, 290, 390, 397, 402
See application file for complete search history.

(56) References Cited

U.S. PATENT DOCUMENTS

| | | | | |
|---|---|---|---|---|
| 4,821,997 | A | 4/1989 | Zdeblick | 251/11 |
| 6,080,050 | A * | 6/2000 | Chen et al. | 451/288 |
| 6,110,025 | A * | 8/2000 | Williams et al. | 451/286 |
| 6,113,480 | A * | 9/2000 | Hu et al. | 451/289 |
| 6,143,123 | A * | 11/2000 | Robinson et al. | 156/344 |
| 6,196,905 | B1 * | 3/2001 | Inaba | 451/288 |
| 6,215,642 | B1 * | 4/2001 | Sogard | 361/234 |
| 6,277,009 | B1 * | 8/2001 | Chen et al. | 451/288 |
| 6,325,696 | B1 * | 12/2001 | Boggs et al. | 451/5 |
| 6,386,957 | B1 * | 5/2002 | Masumura et al. | 451/59 |
| 6,458,015 | B1 * | 10/2002 | Robinson et al. | 451/11 |
| 6,652,362 | B1 * | 11/2003 | Boo et al. | 451/41 |
| 6,726,537 | B1 * | 4/2004 | Crevasse et al. | 451/41 |
| 6,863,771 | B1 * | 3/2005 | Brown | 451/41 |
| 2003/0053283 | A1 * | 3/2003 | Loo et al. | 361/234 |
| 2003/0211811 | A1 * | 11/2003 | Berman et al. | 451/5 |

OTHER PUBLICATIONS

Vandelli, et al., *Development of a MEMS Microvalve Array for Fluid Flow Control*, J. of Microelectromechanical Systems, vol. 7, No. 4, Dec. 1998.

Henning, et al., *Performance of MEMS-Based Gas Distribution and Control Systems for Semiconductor Processing*, Proceedings, SEMICON West Workshop on Gas Distribution (SEMI, Mountain View, CA, 1998).

* cited by examiner

*Primary Examiner*—M. Rachuba
(74) *Attorney, Agent, or Firm*—K. David Crockett, Esq.; Marc J. Frechette, Esq.; Crockett & Crockett

(57) ABSTRACT

A wafer carrier with a back pressure applicator system adapted to provide high resolution back pressure control. A plurality of millimeter scale distensible elements are disposed between the wafer carrier pressure plate and a process wafer, and selectively distended to provide excess backpressure to select small areas of a wafer known to exhibit resistance to removal vis-á-vis the surrounding wafer surface. Distensible elements may be in the form of expandable pneumatic chambers or electro-mechanical elements such as solenoids, shape memory elements, electrostatic plates, etc.

5 Claims, 8 Drawing Sheets

21
10
1
20
5
5
4
2
22
3
3
2
8
8
9
9
7
6

BACK PRESSURE CONTROL SYSTEM FOR CMP AND WAFER POLISHING

FIELD OF THE INVENTIONS

The inventions described below relate the field of wafer carriers used to hold wafers during chemical mechanical planarization.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical mechanical planarization (CMP) is a process used during device manufacturing to flatten wafers and the layers built-up on wafers to the necessary degree of flatness.

Chemical mechanical planarization is a process involving polishing of a wafer with a polishing pad combined with the chemical and physical action of a slurry pumped onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing. Using this process a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated to build complete integrated circuit chips on the wafer surface.

As integrated circuit chips have become more complex, the standards of flatness and planarization necessary to create the integrated circuits and to achieve high yield in the process have become more and more stringent. At the same time, zones of differential response to the CMP process (due to the topography and underlying architecture of the particular integrated circuits built up on the wafer creates) and prime wafer height variations have become significant relative to the degree of flatness required for many processes in the manufacturing process. In prime wafers, high spots and low spots spanning millimeter-scale zones may be randomly located over the surface of wafer, and the height differential may be on the order of 100 nm. In processed wafers, high spots and low spots spanning millimeter-scale zones tend to be predictably and uniformly arrayed across the surface of the in-process wafer. The arrangement of high spots and/or low spots depends on the particular architecture of the built-up wafer, but is generally predictable from run to run, and it appears that the underlying architecture results in soft spots subject to an increase removal rate under CMP, or in hard spots that are resistant to removal of surface material. The excess wear leading to the low spots is referred to a dishing, and it is problematic because, among other reasons, it limits the resolution of lithography and creates high spots subject to thinning. (It may be appreciated that the terms soft-spot or hard-spot do not necessarily refer to the measured hardness of the wafer surface, and refer more generally to resistance or susceptibility to polishing).

The differential polishing described above differs from typical cross-wafer or center-to-edge differential polishing. Center-to-edge differential polishing describes the uniform over-polishing or under-polishing of the edge of the wafer compared to the center of the wafer. CMP processes have known inherent challenges in controlling center-to-edge uniformity. For example, oxide polishing is typically center-slow (the wafer's edge is polished faster than the wafer's center), while metal and prime wafer polishing are typically center-fast. Thus, annular zones of the wafer are polished differently.

The effects of uneven polishing have previously been addressed by adjusting the backpressure applied to different annular zones of wafer during polishing. The wafer is held against the polishing pad by a wafer carrier. The wafer carrier includes a pressure plate which is used to apply pressure on the back side of the wafer. For processes known to result in differential polishing rates, wafer carriers adapted to apply different backpressure to different zones of the wafer have been used. Pressure plates have been modified to provide for the application of different backpressure on the edge of the wafer and the center of the wafer, and in some cases a third concentric annular zone between the center and the edge. The current systems are useful in many processes. However, the soft-spot and hard-spot differential polishing identified above is not addressed by annular zoned backpressure systems, as the differential wear occurs over the entire surface of the wafer, and results in inconsistent polishing in all the annular zones.

SUMMARY

The methods and devices shown below provide for precisely controlled, millimeter scale (or smaller) adjustments to wafer backpressure applied to a wafer during chemical mechanical polishing. A wafer carrier is provided with numerous distensible elements arrayed on or near the bottom surface of the pressure plate. The distensible elements comprise expandable chambers disposed on a disk fitted between the pressure plate and the wafer. The distensible elements are controlled with necessary valves and pressure sources and computer control systems to exert excess backpressure at select small zones of the wafer. For wafers with known patterns of hard areas which experience relatively low local removal rates, the disk is placed in registration with the wafer, and polishing is performed while distensible elements corresponding to the hard areas are operated to provide excess backpressure corresponding zones of the wafer.

Various embodiments of the distensible elements are described, including silicon bladders, shape memory elements, and electrostatic plates.

DETAILED DESCRIPTION OF THE INVENTIONS

Figure 1:
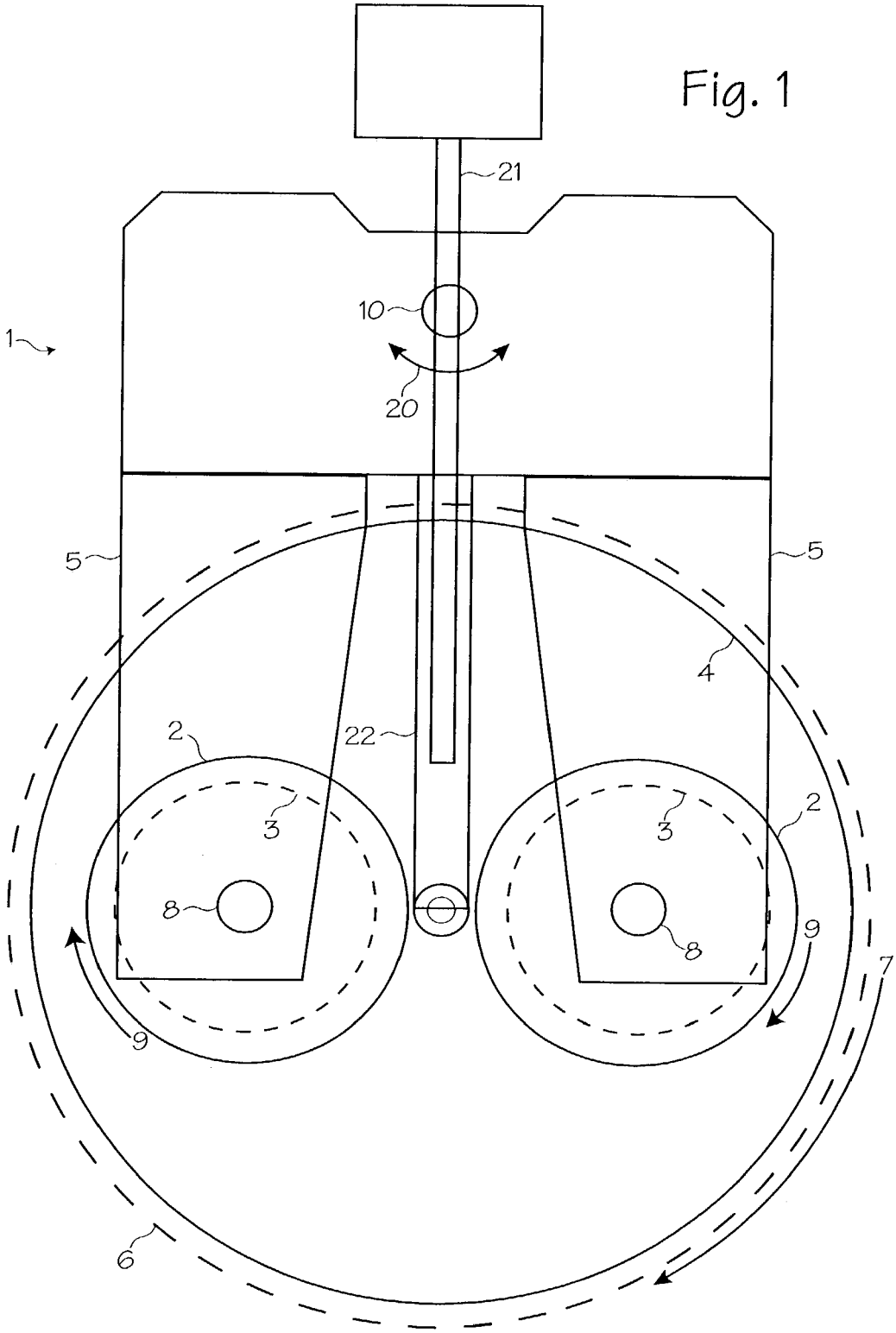
FIG. 1 shows a system for performing chemical mechanical planarization.

FIG. 1 shows a system 1 for performing chemical mechanical planarization. One or more polishing heads or wafer carriers 2 hold wafers 3 (shown in phantom to indicate their position underneath the wafer carrier) suspended over a polishing pad 4. The wafer carriers are suspended from translation arms 5. The polishing pad is disposed on a platen 6, which spins in the direction of arrow 7. The wafer carriers 2 rotate about their respective spindles 8 in the direction of arrows 9. The wafer carriers are also translated back and forth over the surface of the polishing pad by the translating spindle 10, which moves as indicated by arrow 20. The slurry used in the polishing process is injected onto the surface of the polishing pad through slurry injection tube 21, which is disposed on or through a suspension arm 22. (Other chemical mechanical planarization systems may use only one wafer carrier that holds one wafer, or may use several wafer carriers that hold several wafers. Other systems may also use separate translation arms to hold each carrier.)

Figure 2:
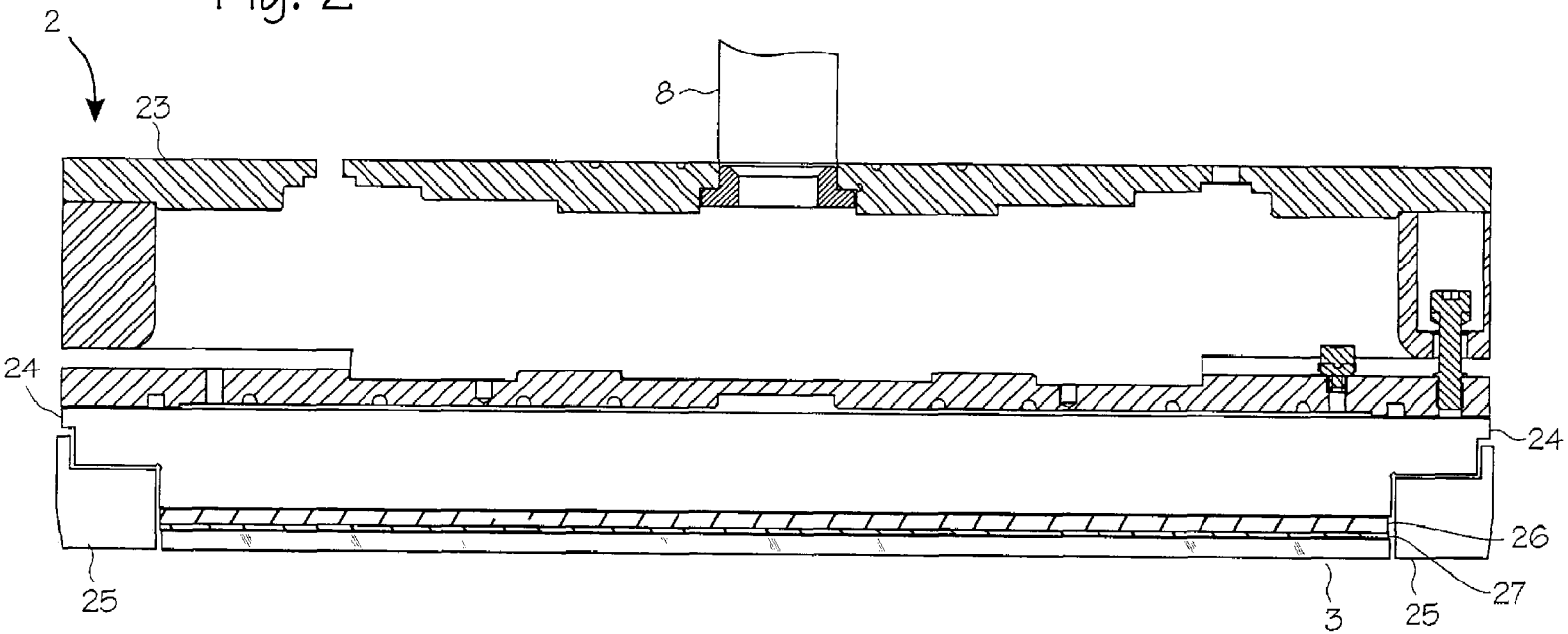
FIG. 2 is a cross section of a wafer carrier adapted to apply backpressure to numerous regions of a wafer during polishing.

FIG. 2 is a cross section of a wafer carrier adapted to apply back pressure to numerous regions of a wafer during polishing. The wafer carrier 2 includes a carrier housing 23, a pressure plate 24, and a retaining ring 25. A wafer 3 is illustrated in FIG. 2, positioned as it would be during use below the pressure plate. During polishing, the entire wafer carrier is rotated about spindle 8, while the pressure plate pushes against the back of the wafer, forcing it against the polishing pad (3) while holding the wafer flat. Various mechanisms within the carrier housing may be used to join the pressure plate to the carrier housing and control downward pressure to the pressure plate. An array of distensible elements is disposed within pressure applicator assembly 26. The pressure applicator assembly is disposed on the lower portion of the pressure plate, provided integrally with the pressure plate or as a separate insert or plate disposed below the pressure plate. A resilient insert 27 may be disposed, as illustrated, between the pressure applicator disk and the wafer.

Figure 3:
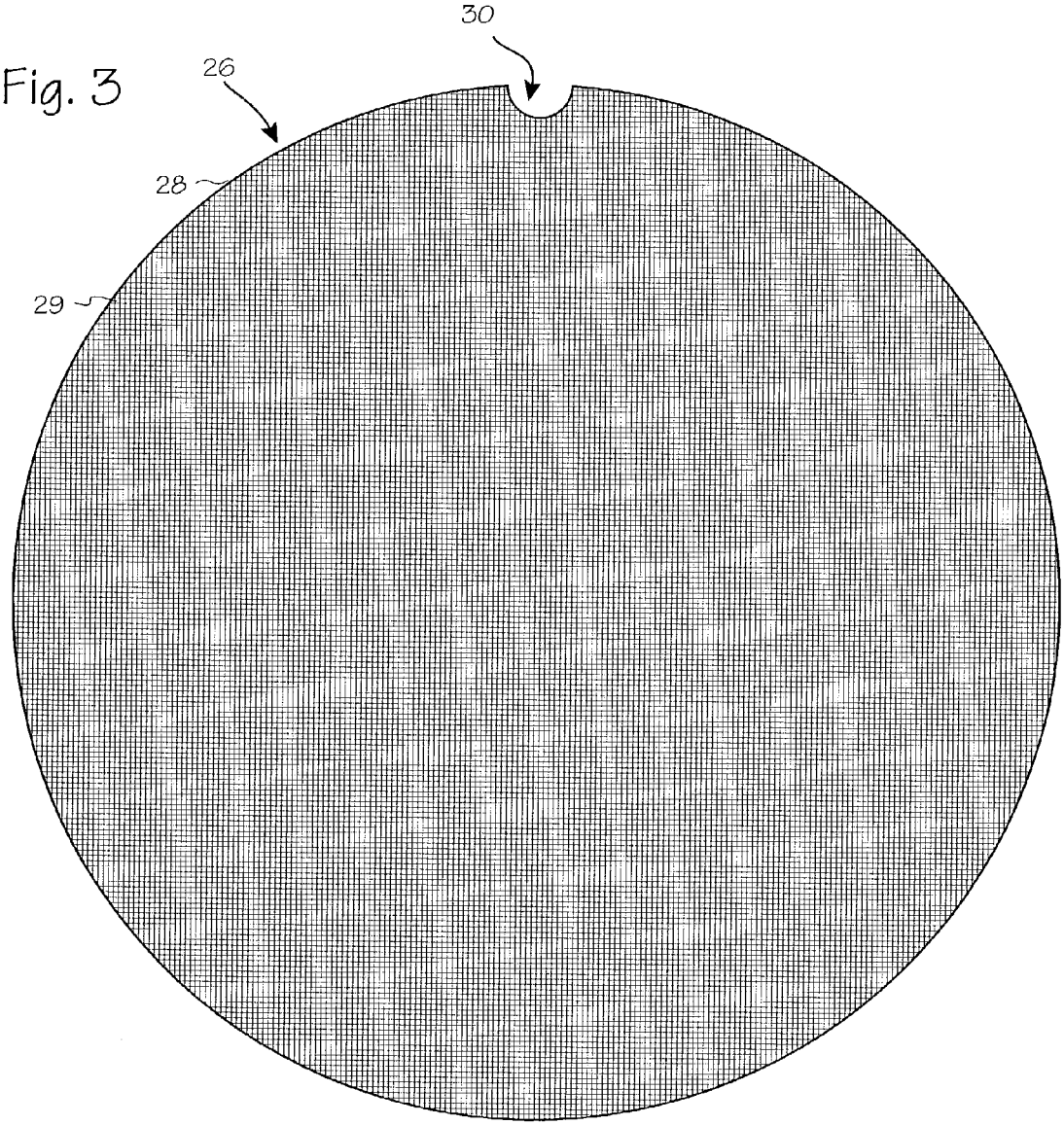
FIG. 3 illustrates an array of distensible elements on a backpressure applicator.

The backpressure applicator is preferably constructed as an array of MEMS devices. FIG. 3 illustrates an array of distensible elements on a backpressure applicator assembly 26. The backpressure applicator assembly comprises a disk 28 with the same diameter as the product wafer 3. Built into one surface of the backpressure applicator disk are thousands of distensible elements, approximately 1 mm square. The distensible elements are arranged in a predetermined array geometry (which may be a square grid, as illustrated, or any other geometry) to establish numerous backpressure zones 29 covering an area of 1 $mm^2$ each. Thus, a 200 mm disk will include about 31,000 elements, and a 300 disk will include about 70,000 elements. The disk also includes a notch 30 corresponding to the typical notch of the wafer.

Figure 4:
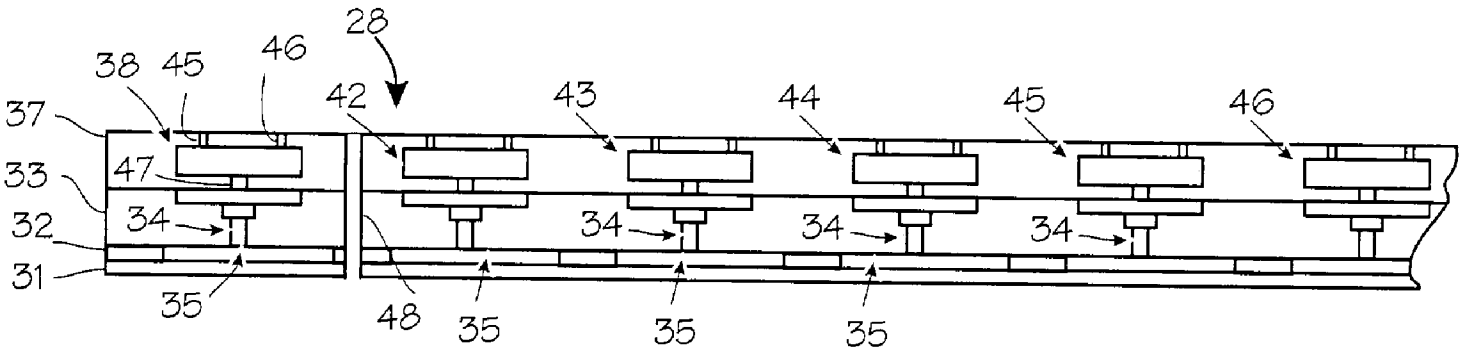
FIG. 4 is a cross section of the backpressure applicator of FIG. 3.

FIG. 4 is a cross section of the backpressure applicator disk of FIG. 3, in an embodiment in which uses distensible elements comprises selectively addressable chambers, and the means for distending the elements comprises a pressurized fluid and pressure control valves aligned between the pressurized fluid source and the chambers. The disk comprises several wafers sandwiched together. The first layer, wafer contacting layer 31, is a thin plate or membrane (20–50 microns thick). This layer forms the outer surface of the distensible elements. This layer is bonded via glass bonding layer 32 to a pipe layer 33. The glass bonding layer is very thin, for example 100 nm, and establishes a screen-like structure with apertures corresponding to the desired pressure zones of FIG. 3. The pipe layer 33 has numerous fluid pathways 34 communicating with the various chambers 35 formed by the boundaries of the first layer, the beads of the glass bonding layer, and the surface of the manifold layer.

A valve layer 37 contains numerous pressure control valves 38, 39, 40, 41, 42 and 43 with outlets 44 aligned to corresponding holes in the pipe layer. Inlet ports 45 provide for fluid communication from a pressurized fluid source, relief ports 46 provide for exhaust of fluid from the chamber, and outlet ports 47 provide for fluid communication from the valves to the fluid pathways 34 of the pipe layer. The valves are operated as necessary to maintain desired pressure in the chambers. The valves may be individually addressed, like pixels on a display, with appropriate chip addressing technology.

Figure 5:
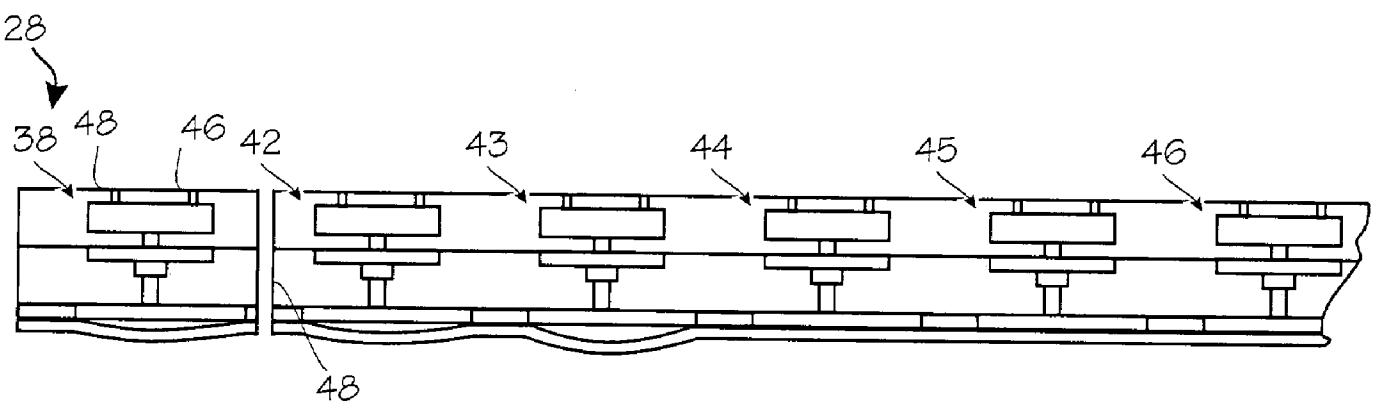
FIG. 5 illustrates the operation of the backpressure applicator of FIG. 4.

FIG. 5 illustrates the operation of the backpressure applicator of FIGS. 3 and 4. The valves are aligned to a fluid source that is lightly pressurized, in the range of 1 to 15 psi depending on the application (typical back pressure overpressure is about 3 to 5 psi for most polishing processes, and about 1 psi for copper removal). Each valve may be controlled separately to pressurize the associated chamber, and distend the portion of the wafer-contacting layer over the chamber. For example, valves 38, 39, and 40 are controlled to pressurize the associated chambers, so that the associated portion of the wafer-contacting layer is distended (when unloaded) relative to the fixed portions of the layer, while valves 41 and 42 are controlled to limit the chamber pressure so that the wafer contacting surface is level with fixed portions. Thus the silicon wafer of the wafer-contacting layer acts as a membrane spanning the bottom surface of the pressure plate, with the locally distensible portions of the membrane serving to transmit backpressure to the wafer. As illustrated relative to valve 43, with appropriate evacuation of the relief port (i.e., applying a vacuum to the relief port), valves may be controlled to evacuate the chamber to withdraw the wafer contacting layer from the baseline level of the fixed portions of the wafer contacting layer.

Figure 6:
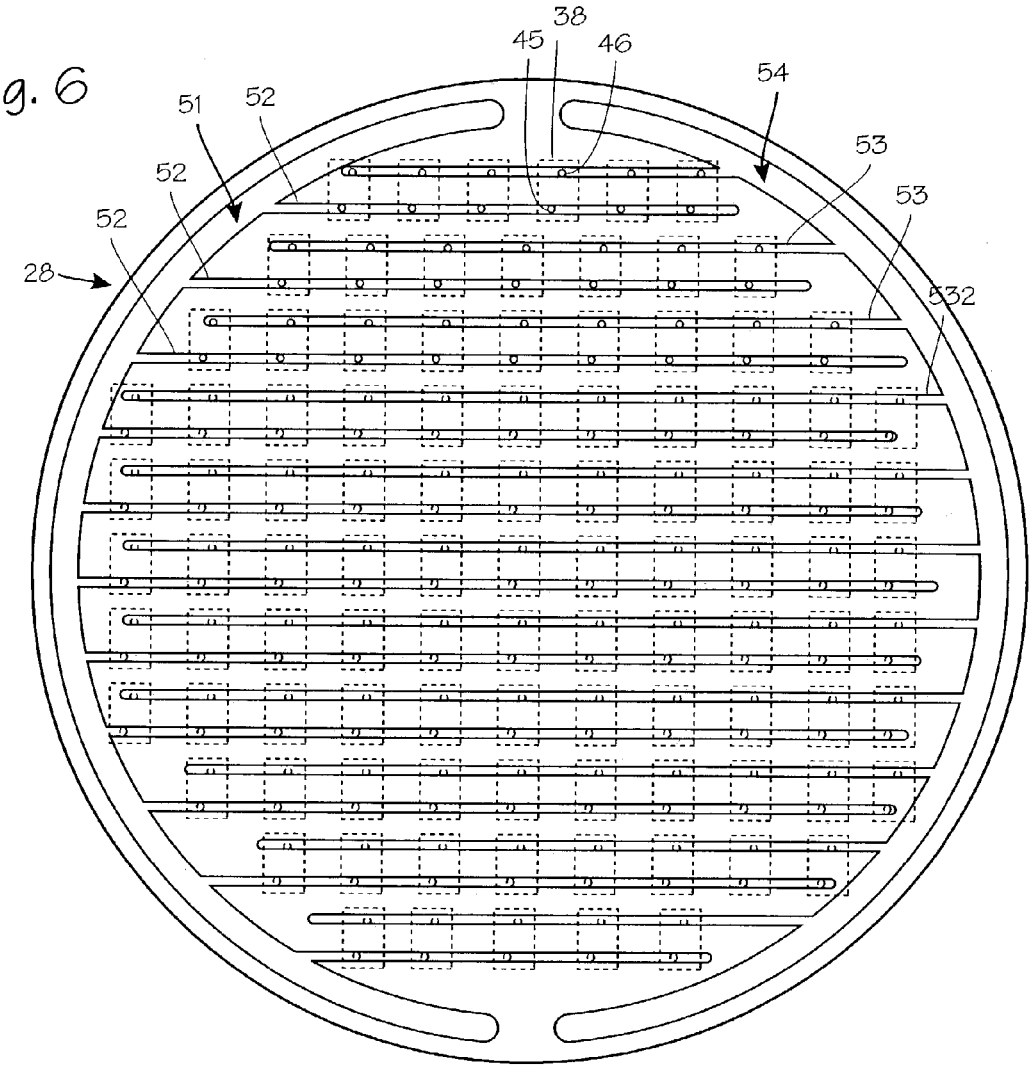
FIGS. 6 and 7 illustrate fluid supply systems for use with the backpressure applicator disk of FIGS. 4 and 5.
Figure 7:
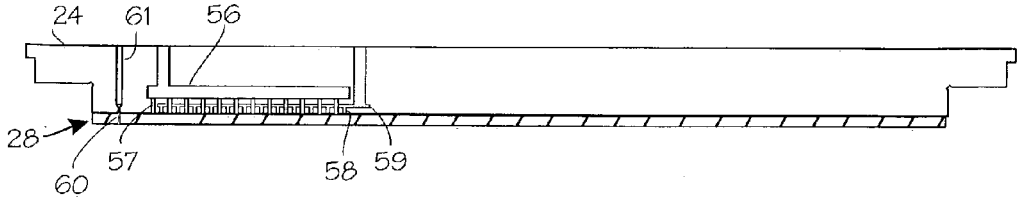

FIGS. 6 and 7 illustrate fluid supply systems for use with the backpressure applicator disk of FIGS. 4 and 5. In FIG. 6, fluid supply and exhaust manifolds are provided in the backpressure applicator disk 28. A pressurized fluid supply manifold 51 is provided in the form of channel (covered or uncovered) in the surface of the valve layer 37. Numerous supply pipes 52 provide a fluid pathway from the manifold to individual inlet ports 45 of various valves 38. Likewise, numerous exhaust pipes 53 provide a fluid pathway from the individual valve outlet ports 46 to an exhaust manifold 54. The bottom surface of the pressure plate may provide the upper boundary of the channel, and the secure attachment of the backpressure applicator disk to the pressure plate will establish fluid-tight channels. Alternatively, the valve layer may be capped with an additional layer to provide fluid tight channels, leaving only necessary inlets and outlets over the manifolds. To supply pressurized fluid and an exhaust pathway, the pressure plate to be used with the backpressure applicator disk of FIG. 6 is modified by the addition of fluid supply and exhaust conduits aligned to the respective manifolds in the backpressure applicator disk. Pressurized fluid is provided from an outside pressure source, and exhaust vacuum, if any, is provided from an outside vacuum source, with appropriate plumbing through the wafer carrier.

FIG. 7 illustrates an embodiment of the system in which the pressurized fluid supply manifold and exhaust manifolds are provided within the pressure plate. As illustrated, the pressure plate 24 includes a pressurized fluid manifold 56 with numerous outlets 57 each directed toward a corresponding pressure regulator valve in the backpressure applicator disk 28. The manifold is pressurized from an outside pressure source, with appropriate plumbing through the wafer carrier. Exhaust channels 58 in the pressure plate, aligned with exhaust ports of the valves in the backpressure applicator disk, communicate with the exhaust manifold 59 in the pressure plate. Again, pressurized fluid supply and exhaust conduits may be provided through the wafer carrier. Also illustrated in FIG. 7 is the portion of the typical wafer holding vacuum system which is disposed in the pressure plate and backpressure applicator disk. The pressure plate and backpressure applicator disk are provided with occasional vacuum channels 60 (in the backpressure applicator disk) and 61 (in the pressure plate). The vacuum channels 60 run completely through the backpressure applicator disk, are aligned with the vacuum channels 61 in the pressure plate. These vacuum channels are provided so that the wafer may be held to the carrier by vacuum applied through the pressure plate, backpressure applicator disk and insert. These vacuum channels may be sized and located so that the pass through the glass bonding layer, or they may be placed in lieu of the expandable chambers. Loss of a few chambers is not expected to significantly degrade the performance of the system, especially if zones used for wafer holding are located in areas corresponding to the wafer in which excess backpressure is expected to be unnecessary.

The layers may be fabricated from silicon wafers and other materials using known etching and deposition, and layering techniques. The wafer-contacting layer may be provided in fairly thick layer of silicon, then heat pressed onto the pipe layer with the glass layer sandwiched between them, so that the glass layer melts to fuse the other two layers together. The wafer-contacting layer may also be made of material of different flexibility, such as silicon nitride, parylene, bisbenzo-cyclobutene (BCB), resins such as cyclohexanone (SiLK®) and other polymers that can be evenly deposited with appropriate assembly techniques. Even elastomeric materials such as silicone rubber may be used for the wafer contacting layer. The glass layer may be deposited on the pipes layer, and voids may be etched from the deposited glass to leave a grid of glass beads about 100 nm deep and 100 microns wide. The channels of the pipes layer may be formed by several etchings of a silicon wafer, with a first bore of about 500 micron diameter, a second bore of about 50 micron diameter, and a final bore of about 200 nm. The wafer 31 and pipe layer 33 are pressed together and heated in order to melt the glass layer and thereby fuse the glass beads to the wafer contacting layer. The wafer-contacting layer may then be ground to a thickness that permits sufficient flexure of the layer to distend under pressure applied to it through the pipes layer (20 to 50 microns).

The valves layer may be constructed with known techniques for manufacture of MEMs valves on silicon and glass substrates. MEMS micro-arrays described in Vandelli, *Development of a MEMS Microvalve Array for Fluid Flow Control*, the silicon micro-fabricated valve described in Henning, et al., *Evaluating the use of MEMS-based gas and fluid delivery systems*, silicone-on-silicon valves and many other valves may be used.

In use, the valves are controlled to pressurize chambers corresponding to known hard spots on wafers. The location of hard spots depends on many complex factors, but for given IC architecture and CMP process variables, hard spots and soft spots occur in predictable areas of the wafer surface. On a wafer with many IC build up on the surface, an ordered matrix of hard spots is typical, so that, relative to the wafer, areas requiring more or less back pressure may be empirically determined. During polishing corresponding chambers of the zoned pressure applicator may be pressurized to increase the removal rate on these hard spots to match the removal rate of the surrounding wafer surface. This requires registration between the wafer and the zoned pressure applicator, and this is easily achieved by first, determining empirically the location of hard spots of a model wafer, aligning the wafer to be polished with the zoned pressure applicator with any suitable registration feature. Because the zoned pressure applicator and the wafer to be polished are fabricated from similarly substrates, the notch or flat of each may be aligned during polishing to keep the array of chambers aligned with the matrix of hard spots. During polishing, the chambers associated with hard spots may be pressurized to increase the back pressure applied to the wafer at each hard spot. Should the wafer be subject to hard spots with differing degrees of resistance to polishing, the back pressure may be varied accordingly to achieve a simultaneous endpoint for all regions of the wafer. Where pressure regulating valves are used, the pressures in various chambers may be controlled on a chamber-by-chamber basis, so that each chamber may be pressurized to a different degree. In more rudimentary operation, the valves may be operated without a pressure regulating function, and the pressurized fluid source may be provided at a predetermined, desirable pressure corresponding to the desired overpressure, and the valves may be opened to subject the associated chambers to the desired overpressure.

Figure 8:
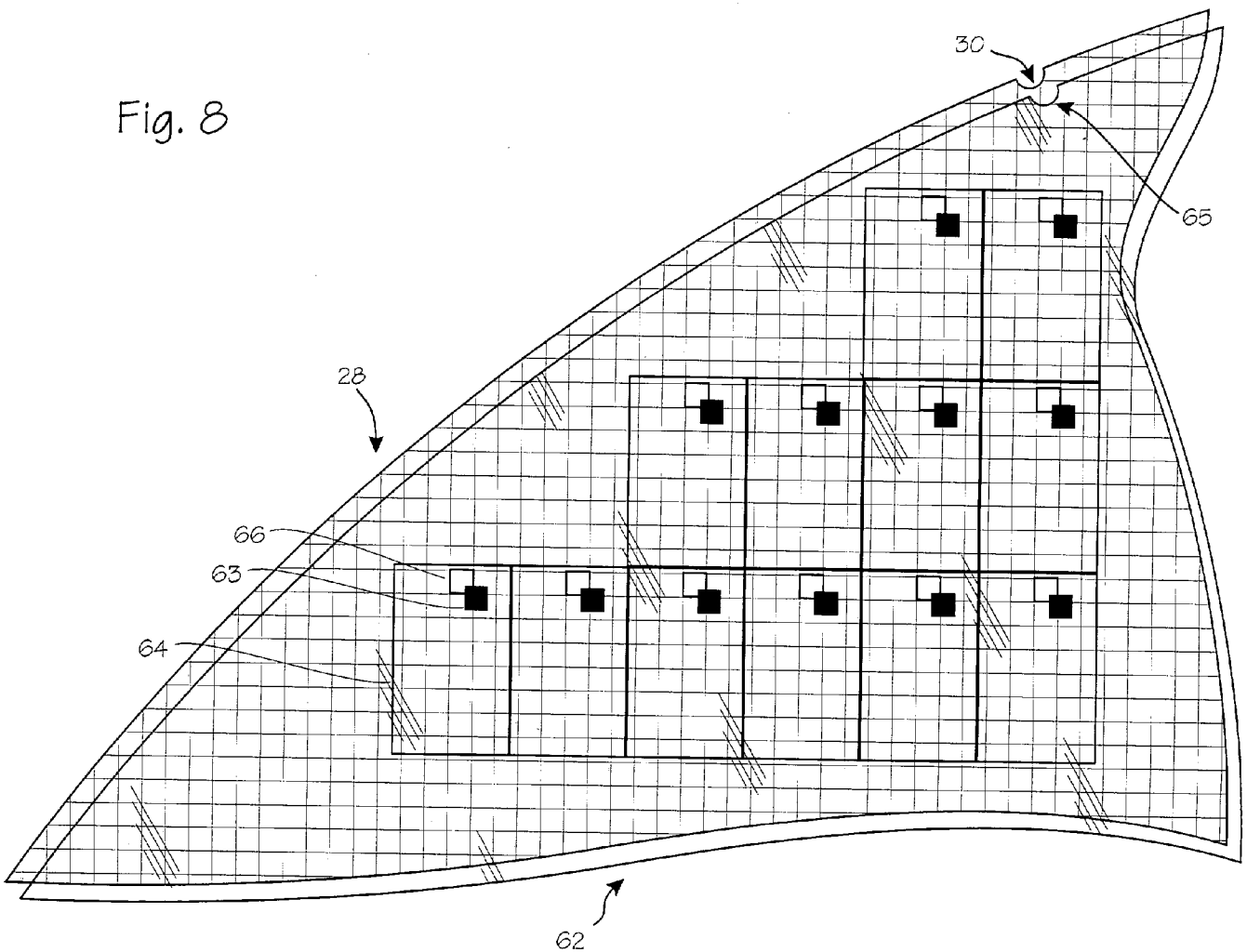
FIG. 8 illustrates a model distribution of hard spots and backpressure zones on a wafer and backpressure applicator.

As illustrated in FIG. 8, a process wafer 62 is expected to have hard spots 63, as determined empirically by polishing a model wafer of the same architecture. The hard spots occur in same location relative to the devices 64 which are built up on the process wafer, and so present a known matrix of high or wear-resistant spots. The process wafer is placed under the backpressure applicator disk 28, with the notch 65 of the process wafer aligned with the notch 30 of the back pressure applicator. During polishing, chambers 66 of the backpressure applicator, which are aligned with the hard spots 63, are pressurized to exert additional backpressure on the process wafer under the hard spots (while all other chambers are not pressurized, or pressurized to a different degree). Numerous hard spots on the surface of the process wafer within a single device may be addressed at the same time.

A computer control system with appropriate software and memory, along with electronics for addressing the valves, is used to control the valves as desired. The location of hard spots is entered into the computer and stored in memory, and the computer is programmed to control valves corresponding to the hard spots to increase the backpressure on the wafer in regions corresponding to the hard spots.

Figure 9:
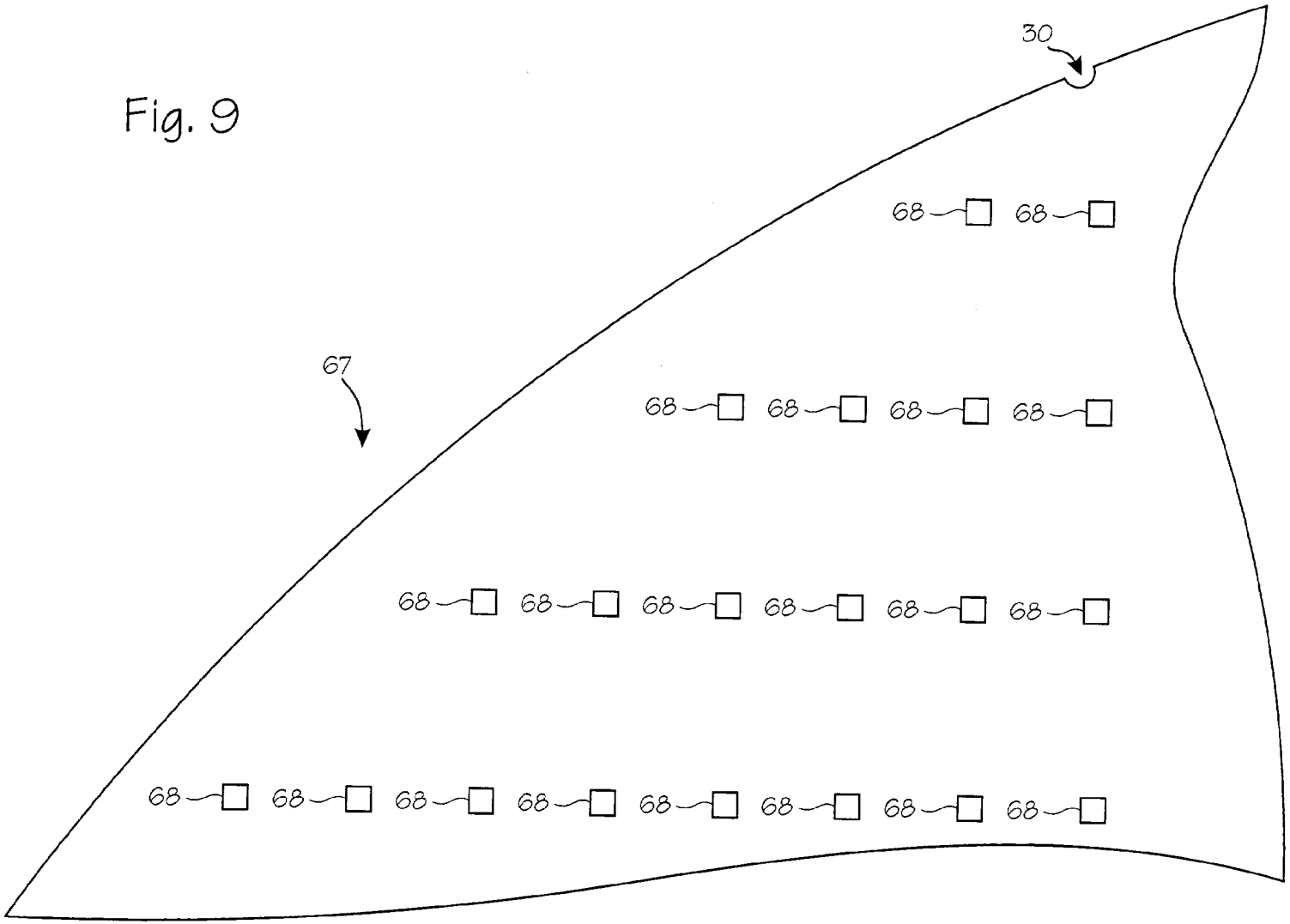
FIG. 9 shows a backpressure applicator with a low density array of backpressure zones.

The backpressure applicator disk may be provided with a complete array of valves, as illustrated in the previous figures. However, for high volume production of process wafers, custom-made backpressure applicator disks with low-density arrays of valves, arranged on the disk to correspond to the known hard spots, may be most economical. A custom backpressure applicator disk is illustrated in FIG. 9, which shows a backpressure applicator assembly 67 with a low-density array of backpressure zones suitable for use with the process wafer of FIG. 8. In this backpressure applicator, chambers 68 are formed only in areas corresponding to the hard spots known to exist on the process wafer.

Figure 10:
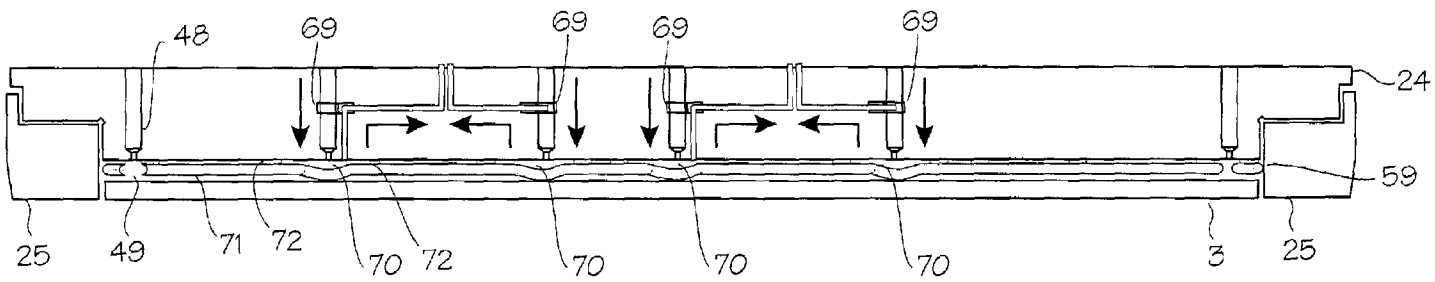
FIG. 10 illustrates a wafer carrier with the high resolution array of expandable chambers constructed directly on the pressure plate.

Though the distensible elements are conveniently provided as expandable chambers constructed as indicated in reference to FIGS. 4 and 5, various other constructions may be used. Alternative constructions may of course be implemented. FIG. 10 illustrates a wafer carrier with the high resolution array of distensible elements in the form of expandable chambers constructed with several of the components disposed within the pressure plate. In this Figure, the pressure plate 24 is modified with the inclusion of numerous pressure regulator valves 69 with outlets aligned to expandable chambers 70 formed between the boundaries of the membrane 71 and chamber side walls 72, disposed directly on the bottom surface of the pressure plate. The membrane may be provided in addition to, or in lieu of, the insert typically used between the pressure plate and wafer. The valves may be disposed within the pressure plate, or may even be provided in a separate array of valves fixed to the upper surface of the pressure plate. That is, the valve array and chamber array may be provided as distinct, separate components of the carrier. (In this manner, customizable chamber arrays may be combined with full valve arrays to provide the benefits of the custom array of FIG. 9). As described in the previous figures, vacuum channels 60 running through the backpressure applicator disk are aligned with the vacuum channels 61 running through the pressure plate to apply vacuum to wafer 3.

Figure 11:
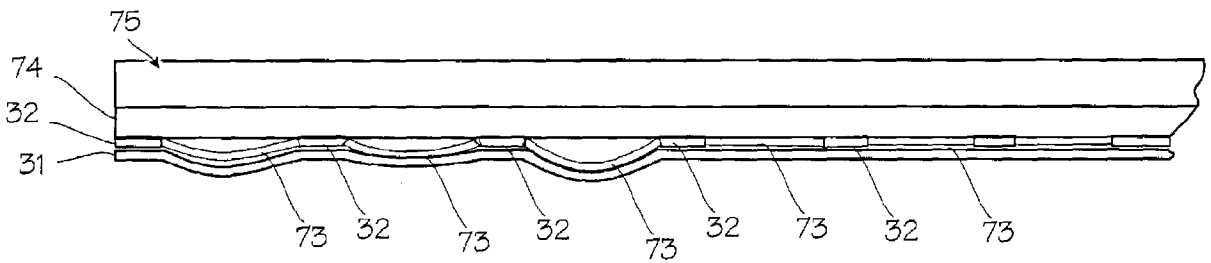
FIG. 11 is a cross section of an array of distensible elements comprising shape memory elements on a backpressure applicator

Many MEMs type devices may be formed in the back pressure applicator and operated to provide high density, addressable array of back pressure zones. As illustrated in FIG. 11, the distensible elements may comprise shape memory elements 73 trained to bow outwardly upon heating, and heating may be provided with small electrical current applied to the elements. The transition temperature of the elements is slightly above ambient process temperature (typically 22 to 100° C.), so that only slight heating is required. The shape memory elements may be formed according to MEMs manufacturing techniques, including sputtering nickel and titanium onto a wafer and etching away extraneous sputter, or through other macro and/or micro machining techniques. Typical IC processes for building electrical leads may be used to install the required electrical leads for addressing each element into a circuit layer 74. The shape memory elements may act directly on the wafer, or may act on the wafer contacting layer as illustrated, with the wafer contacting layer 31 secured to the applicator disk 75 via a glass bonding layer 32. In addition to the illustrated construction using shape memory elements, the distensible elements may also be formed as piezoelectric elements, electrostatic plates, solenoids, bimetal thermostatic elements, etc.

The high-resolution backpressure applicator can be used in other process. For example, prime wafers exhibit randomly dispersed local millimeter scale non-planarities of 100 nm or more. While insubstantial in current processes, these non-planarities may be considered substantial relative to increasingly dense and small-scale architectures. These prime wafers may be polished to eliminate the local plateaus with the backpressure applicator by first imaging a particular disk to determine the location of high spots, feeding information regarding the location of high spots to the control system, and then polishing the particular disk while distending elements disposed in proximity to the high spots. Also, though it is overkill, the high-resolution backpressure applicator can be used in place of current annular zone backpressure devices to address cross-wafer variations in removal rates. For center-slow processes, a circular grouping of elements may apply over pressure to the center region of the wafer. For edge-slow (center-fast) processes, and annular grouping of distensible elements may be pressurized. Using this procedure, a large number of distinct annular zones can be differentially polished, and the annular zones may be adjusted during the process, or between polishes, without replacing the carrier or carrier components.

While the inventions have been described in the context of chemical mechanical polishing, they may be employed in any polishing or grinding system. The various materials and methods may be modified as needed for particular applications. For example, the chambers may be provided in any shape, and the material for the wafer contacting layer may be varied to provide more or less flexibility than the silicon membrane described in relation to the figures. The density and arrangement of the distensible elements may also be varied to suit the application, as described in relation to FIG. 9. Additionally, though intended to address issues of global non-planarity vs. local planarity on the scale of millimeters, the array of distensible elements may be operated to address larger or smaller non-planarities. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A wafer carrier for use in wafer polishing, said wafer carrier comprising a carrier housing, a pressure plate and a retaining ring surrounding the pressure plate and extending below the pressure plate to form a cylindrical recess sized to receive the wafer, said wafer carrier further comprising:

a plurality of downwardly distensible elements;

wherein the downwardly distensible elements comprise expandable chambers; and wherein the distensible elements are disposed within a removable disk disposed below the pressure plate and within the bounds of the cylindrical recess.

2. A wafer carrier for use in wafer polishing, said wafer carrier comprising a carrier housing, a pressure plate and a retaining ring surrounding the pressure plate and extending below the pressure plate to form a cylindrical recess sized to receive the wafer, said wafer carrier further comprising:

a plurality of downwardly distensible elements disposed on or below the bottom surface of the pressure plate wherein the downwardly distensible elements comprise expandable chambers;

a manifold within the pressure plate in fluid communication with a pressurized fluid source;

a plurality of fluid pathways communicating from the manifold to the expandable chambers; and a plurality of valves disposed in the fluid pathways, said valves being operable to maintain pressure in the expandable chambers.

3. The wafer carrier of claim 2 wherein the plurality of valves are pressure regulating valves operable to maintain pressure in the expandable chambers at variable operator selectable levels.

4. The wafer carrier of claim 1 further comprising:

a manifold within the pressure plate in fluid communication with the pressurized fluid source;

a plurality of fluid pathways communicating from the manifold to the expandable chambers;

a first plurality of pressure regulating valves disposed in a first set of the fluid pathways, said first plurality of pressure regulating valves able to maintain a first preset pressure in the expandable chambers;

a second plurality of pressure regulating valves disposed in a second set of the fluid pathways, said second plurality of pressure regulating valves able to maintain a second preset pressure in the expandable chambers.

5. The wafer carrier of claim 1 wherein the removable disk further comprises:

a manifold within the disk in fluid communication with a pressurized fluid source;

a plurality of fluid pathways communicating from the manifold to the expandable chambers; and a plurality of valves disposed within the disk, in the fluid pathways, said valves being operable to maintain pressure in the expandable chambers.

* * * * *